US010414610B2

(12) United States Patent
Fogle

(10) Patent No.: US 10,414,610 B2
(45) Date of Patent: Sep. 17, 2019

(54) TAPE HOLDER

(71) Applicant: Bruce Fogle, San Rafael, CA (US)

(72) Inventor: Bruce Fogle, San Rafael, CA (US)

( * ) Notice: Subject to any disclaimer, the term of this patent is extended or adjusted under 35 U.S.C. 154(b) by 0 days.

(21) Appl. No.: 15/944,261

(22) Filed: Apr. 3, 2018

(65) Prior Publication Data

US 2018/0222708 A1 Aug. 9, 2018

Related U.S. Application Data

(63) Continuation-in-part of application No. 15/696,936, filed on Sep. 6, 2017, which is a continuation-in-part of application No. 15/530,006, filed on Nov. 18, 2016, now abandoned.

(51) Int. Cl.
*B65H 16/00* (2006.01)
*B65H 16/02* (2006.01)

(52) U.S. Cl.
CPC ..... *B65H 16/02* (2013.01); *B65H 16/005* (2013.01); *B65H 2701/19* (2013.01)

(58) Field of Classification Search
CPC ..... B65H 35/0073; B65H 35/0026
USPC ..... 224/268–271
See application file for complete search history.

(56) References Cited

U.S. PATENT DOCUMENTS 510,835 A * 12/1893 Blair ..... A47G 21/14 248/229.16
1,196,737 A * 8/1916 Hammond ..... A47G 21/14 248/229.26
2,320,067 A * 5/1943 Caughren ..... A01M 31/006 224/248
2,987,231 A * 6/1961 Lewis ..... B44D 3/14 224/148.4
3,326,433 A * 6/1967 Koch ..... B65D 47/286 206/537
3,508,691 A * 4/1970 Langbehn ..... A62B 35/00 224/248
D240,370 S * 7/1976 Kuehl ..... D3/228
4,457,462 A * 7/1984 Taormina ..... B25H 3/00 224/269
D275,527 S * 9/1984 Gee ..... 224/268
4,809,894 A * 3/1989 Viio ..... A45F 5/02 224/248
4,936,499 A * 6/1990 Gulley ..... A45F 5/02 206/364
4,974,764 A * 12/1990 Cantwell ..... A45F 5/02 224/269
D377,896 S * 2/1997 Mesna ..... D8/367
5,687,892 A * 11/1997 Johns ..... A45F 5/02 224/268
6,199,736 B1 * 3/2001 Musarella ..... A45F 5/02 224/667

(Continued)

*Primary Examiner* — Brian D Nash
(74) *Attorney, Agent, or Firm* — Christopher Peil; Law Office of Christopher Peil

(57) ABSTRACT

A tape holder allows a person to hold and dispense masking tape easily when preparing for painting or performing other tape related activities. The tape holder may include a first portion that is capable of sliding into or out of a person's pants pocket while a second portion extends out of the pocket and holds one or more rolls of tape. Embodiments of the tape holder are economically made from a single length of bent rod. The tape holder allows the user to easily and quickly remove and replace a roll of masking tape.

7 Claims, 6 Drawing Sheets

(56) References Cited

U.S. PATENT DOCUMENTS

| | | | | |
|---|---|---|---|---|
| 6,279,797 | B1 * | 8/2001 | Snyder | A45F 5/02 224/268 |
| 6,374,577 | B1 * | 4/2002 | Ventura | A45F 5/02 206/554 |
| 6,994,238 | B2 * | 2/2006 | Estabaya | A45F 5/02 224/247 |
| 7,140,148 | B1 * | 11/2006 | Williams, II | A01K 91/02 43/54.1 |
| D608,622 | S * | 1/2010 | Zhu | D6/513 |
| D633,739 | S * | 3/2011 | Hamdia | D3/215 |
| 2006/0261116 | A1 * | 11/2006 | Brandeis | A45F 5/02 224/671 |
| 2007/0170220 | A1 * | 7/2007 | Fragassi, III | A45F 5/02 224/660 |

* cited by examiner

TAPE HOLDER

CROSS REFERENCE TO RELATED APPLICATIONS

This application is a continuation-in-part of U.S. patent application Ser. No. 15/696,936, filed Sep. 6, 2017, the entirety of which is incorporated herein by reference.

U.S. patent application Ser. No. 15/696,936 is a continuation-in-part of U.S. patent application Ser. No. 15/530,006, filed Nov. 18, 2016, the entirety of which is incorporated herein by reference.

BACKGROUND

Technical Field

This disclosure relates generally to the field of painting accessories and more specifically to a tape holder.

Technical Background

It is very common to use masking tape or painter's tape when painting walls or a ceiling or other portion of a home or office. The tape acts as a barrier to prevent paint from being applied to surfaces that do not require its presence, for example, when taping the floor that abuts a wall that is to be painted. Painters need to have ready access to tape as they progress in a painting project. It can become tiresome and time consuming to search for and use the tape each time it is needed.

SUMMARY

A tape holder allows a person to hold and dispense tape easily when preparing for painting or performing other tape-related activities. The tape holder may include a first portion that is capable of sliding into or out of a person's pants pocket while a second portion extends out of the pocket and holds one or more rolls of tape. Embodiments of the tape holder are economically made from a single length of bent rod. The tape holder allows the user to easily and quickly remove and replace a roll of tape.

DETAILED DESCRIPTION

A tape holder allows a person to hold and dispense tape easily when preparing for painting or performing other tape-related activities. The tape holder may include a first portion that is capable of sliding into or out of a person's pants pocket while a second portion extends out of the pocket and holds one or more rolls of tape. Embodiments of the tape holder are economically made from a single length of bent rod. The tape holder allows the user to easily and quickly remove and replace a roll of masking tape.

Painters need to have ready access to masking tape or painter's tape as they progress in a painting project. It can become tiresome and time consuming to search for and use the tape each time it is needed. It would therefore be ideal to have a tape holder that is in close proximity to the user so that he or she could have quick and easy access to the tape when needed.

It would therefore be ideal to have a tape holder that is in close proximity to the user so that he or she could have quick and easy access to the tape when needed.

Figure 1:
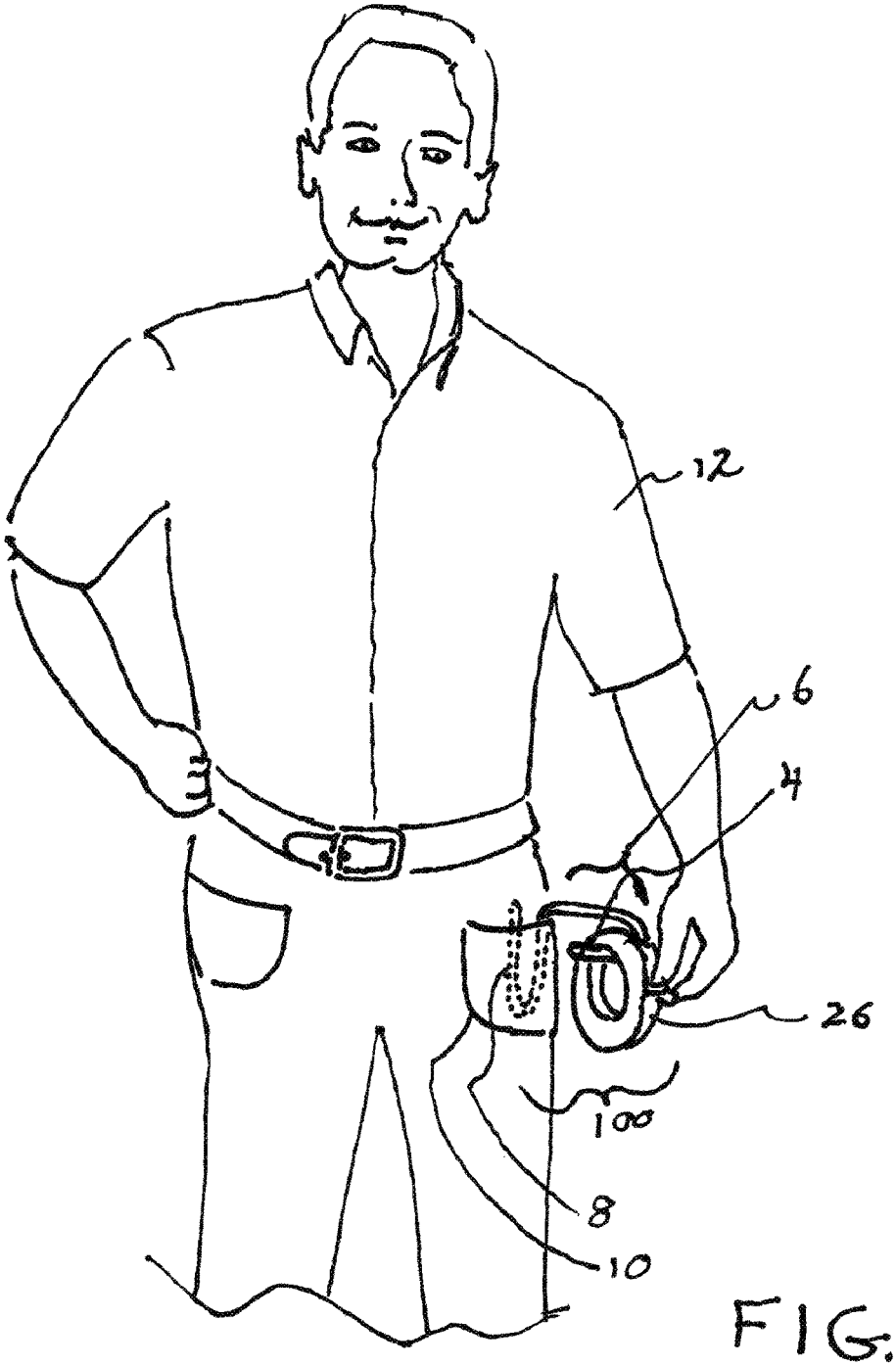
FIG. 1 is a perspective view of a person using a tape holder.

Referring now to FIG. 1 a person 12 is shown getting ready to use the tape holder 100. Embodiments of the tape holder 100 may include a metal rod that is bent to form a first portion 8 and a second portion 6. In embodiments, the metal rod may be bent at a 90-degree angle 24 to form the first 8 and second 6 portions. In embodiments, the metal rod is fabricated from a metal having a smooth finish to facilitate free movement against the rod of the tape roll, as tape is being pulled from the roll. In embodiments, the metal rod may be stainless steel or anodized aluminum. It should be noted that other materials may be used in place of metal, for example a rigid plastic material.

During use, a roll of masking tape 26 is mounted on the rod 4 of the second portion 6. During use, the first portion 8 is inserted into the user's pants pocket. The tape roll 26 is slid onto rod portion 4 by placing it in the gap between first portion 8 and the tip of second portion rod 4 and sliding onto rod 4. The entire assembly 100 can be swung inboard to the left when not being used for accessing tape. It is to be appreciated that use of a rod that is perfectly round facilitates free movement of the tape roll against the tape holder as tape is being pulled from the roll.

Figure 2:
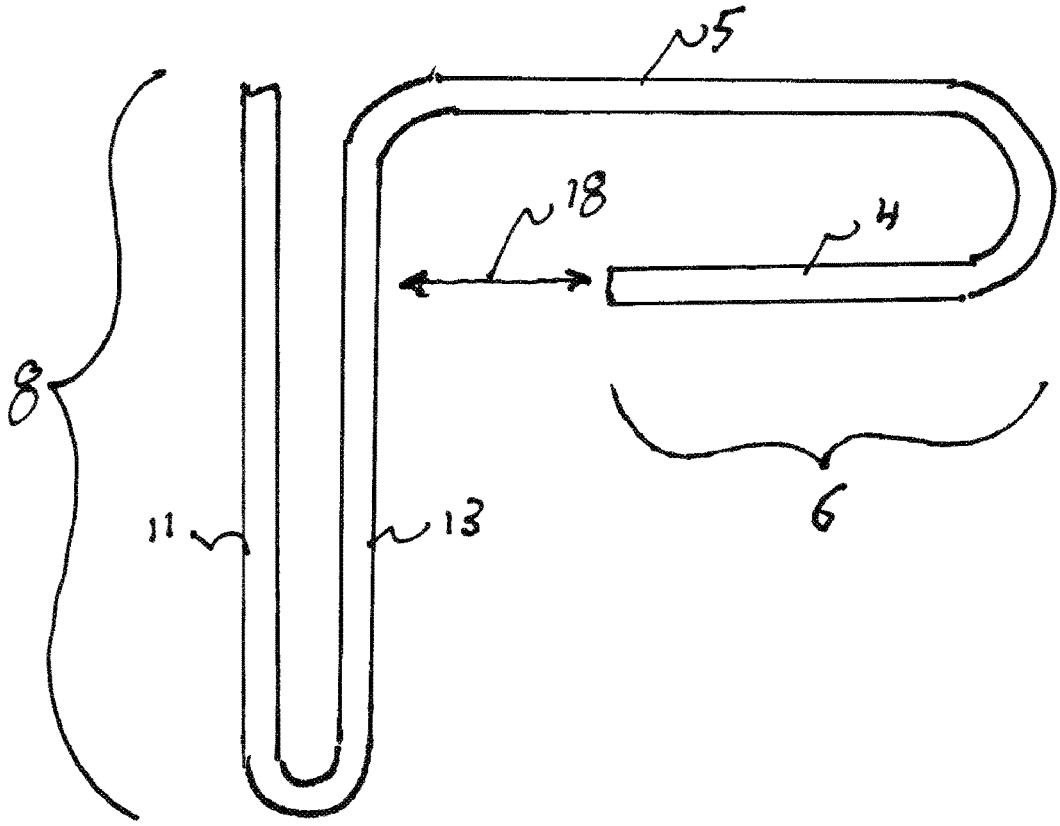
FIG. 2 is a front plan view of the tape holder of FIG. 1.

FIG. 2 is a front plan view of the tape holder 100. The tape holder 100 may be fabricated from a single piece of material such as a metal rod, bent as previously described herein above. In embodiments, the rod is approximately one quarter of an inch in diameter. While other rod diameters are suitable for the tape holder 100, the quarter-inch diameter provides an optimal balance between durability and usability. For example, a rod exceeding one quarter of an inch in diameter would result in an exceptionally durable device, but the resulting device might be difficult to use for long periods because of its weight. A heavier rod would also increase the cost of the device.

As above, the first portion 8 and second portion 6 are formed by the right angle bend 24. The first portion 8 consists of a U bend that results in two arms 11, 13. It should be appreciated that the various elements of the tape holder are dimensioned to fit comfortably into garment pockets such as pockets in carpenter's or painter's jeans and to accommodate multiple rolls of tape. Other embodiments may be differently dimensioned depending on their intended use and the size of the tape rolls they are designed to accommodate.

In embodiments, the arms 11, 13 of the first portion 8 are each approximately six inches long and three quarters of an inch apart.

In embodiments, the second portion 6 consists of a U-bent design where a first leg 5 that results from the right angle bend 24 is approximately five and one half inches long and a second leg 4 is approximately three and one half inches long. The width between legs 4 and 5 may be approximately one and three quarters of an inch. A gap 18 between leg 13 and the tip of leg 4 is approximately one and three quarters of an inch across. During use, the user slips portion 8 in a pocket, and then inserts a roll of tape 26 in the gap 18 and slides it onto leg 4.

Additionally, the tape holder, instead of being inserted into the pocket of a garment, can also be inserted into a loop, such as a belt loop or the type of tool loop often found on painter's or carpenter's jeans.

Figure 3:
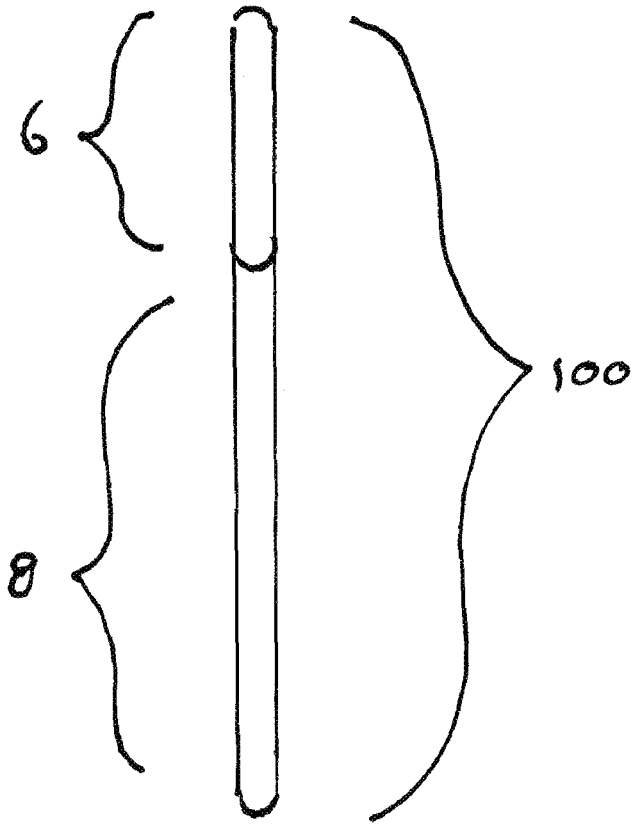
FIG. 3 is a side view of the tape holder of FIG. 1.

FIG. 3 is a side view of the tape holder 100 showing that the entire unit 100 is flat in design and can therefore be compactly stored for shipping or storage.

Figure 4:
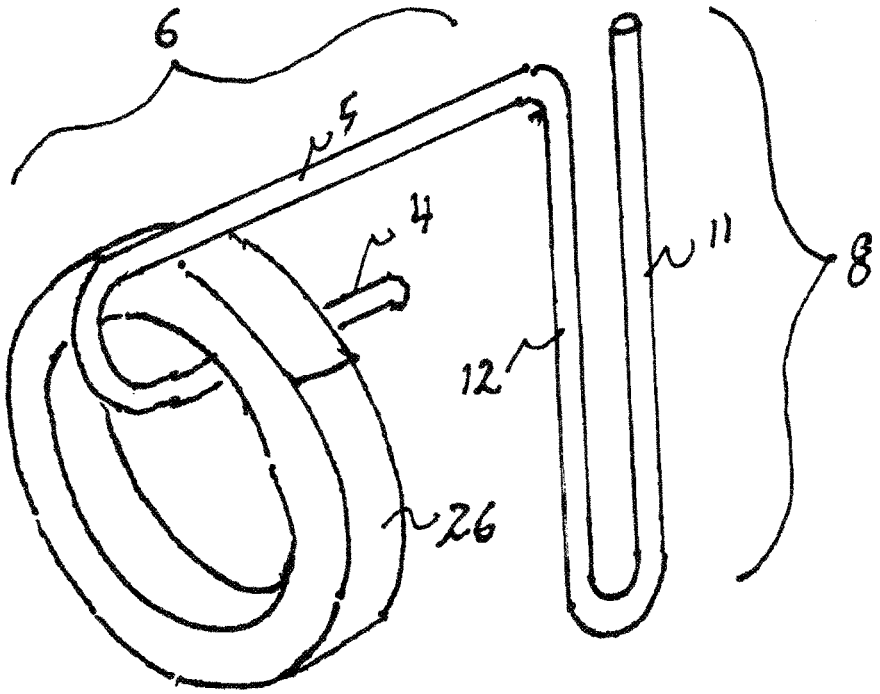
FIG. 4 is a perspective view of the tape holder of FIG. 1.

FIG. 4 is a perspective view of the invention 100 shown removed from a pants pocket.

Figure 5:
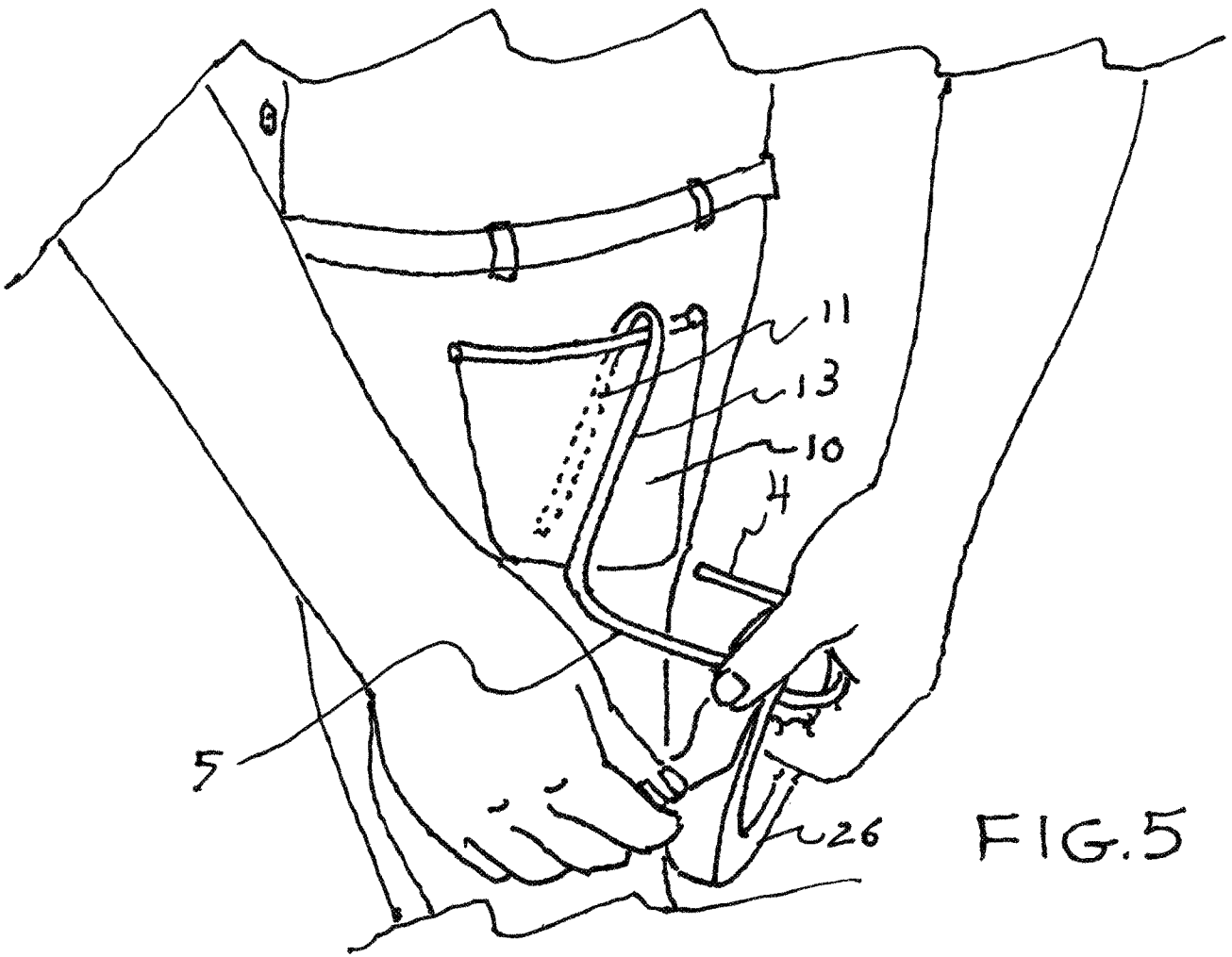
FIG. 5 is a perspective view of a person using the tape holder of FIG. 1 in an alternate manner.

FIG. 5 is a perspective view of a person using the invention in an alternate manner. In this case only one leg 11 of the first portion is inserted into a pocket 10. The other leg 13 extends down from the pocket opening. The user places the masking tape 26 on leg 5 of the second portion. This position locates the tape holding leg 5 in a lower position than that shown in FIG. 1 and therefore may be more comfortable to some users. Additionally, it should be noted that more than one roll of masking tape 26 can be carried on leg 5. There are occasions where a user would like to put stronger sticking masking tape in one location and less strong tape in another location, so the ability to carry multiple rolls is an advantage.

Figure 6:
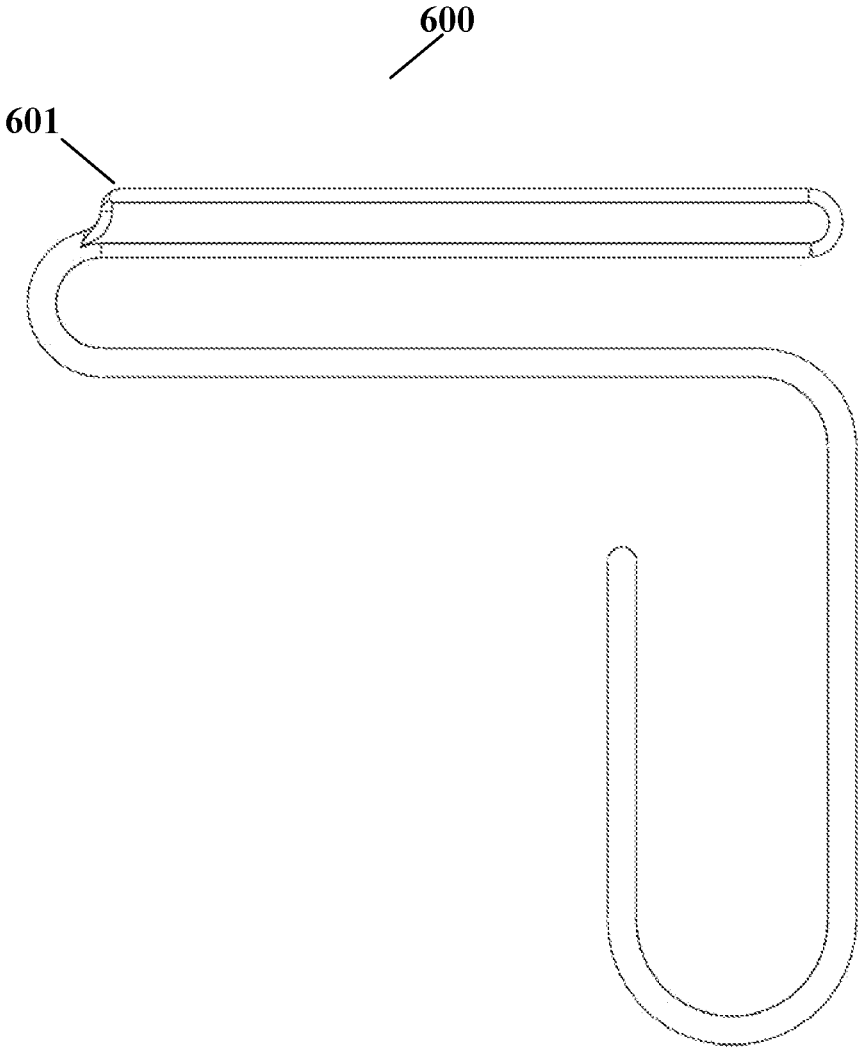
FIG. 6 provides a view of a tape holder having a flattened handle.

FIG. 6 provides a view of a tape holder 600 having a flattened handle 601. In embodiments, the flattened handle may provide a surface upon which a logo or other branding information may be displayed.

Embodiments of the tape holder can be dimensioned and configured to hold any type of tape roll including carpet tape, nursery marking tape or other adhesive tape of any width.

In embodiments, any of the legs 4, 5 and the arms 11, 13 may be flattened, allowing the flattened member to serve as a handle. A logo may be applied to the handle.

Detailed descriptions of embodiments of the tape holder are provided herein above. It is to be understood, however, that the tape holder may be embodied in various forms. Therefore, specific details disclosed herein are not to be interpreted as limiting, but rather as a basis for the claims and as a representative basis for teaching one skilled in the art to employ the device in virtually any appropriately detailed system, structure or manner.

While the tape holder has been described in connection with certain embodiments, the description is not intended to limit its scope to the particular form or forms set forth, but, on the contrary, is intended to cover such alternatives, modifications, and equivalents as may be included within the scope of the disclosure as defined by the appended claims.

The invention claimed is:

1. A tape holder, comprising;

a rod bent ninety degrees to form first portion and second portions;

the first portion capable of sliding into or out of a garment pocket said first portion bent into a U shape and being capable of being removably inserted into a person's pants, or other garment pocket;

wherein said second portion is bent into a U shape where the leg forming the ninety degree bend is five and one half inches and the other leg is three and one half inches, the second portion extending out of the garment pocket and capable of holding at least one roll of tape, said second portion legs being one and three quarters of an inch apart from each other;

wherein a distance from an end of said three and one half-inch leg of said second portion and a six-inch leg of said first portion is one and three quarters on an inch;

said three and three quarter-inch rod length of said second portion capable of removably receiving a roll of tape when said user places said roll of tape in said one and three quarters inch gap and slides said tape onto said three and one half inch-long length of said second portion;

wherein the tape holder has a flat design in one plane that allows for compact packaging, shipping and storage;

wherein the tape holder allows a person to hold and dispense tape easily when preparing for activities involving use of tape; and wherein the tape holder allows the user to easily and quickly remove and replace a roll of tape.

2. The tape holder of claim 1, said rod being one quarter of an inch in diameter.

3. The tape holder of claim 1, wherein said metal rod is fabricated from any of:

stainless steel;

chrome-plated steel;

a thermoplastic polymer; and anodized aluminum.

4. The tape holder of claim 1, wherein said tape holder comprises a single piece of material.

5. The tape holder of claim 1, wherein said tape holder is capable of carrying a plurality of rolls of tape.

6. The tape holder of claim 1, further comprising at least one roll of tape, wherein the at least one roll of tape comprises any of:

masking tape;

painter's tape;

carpet tape;

landscaper's tape; and any type of adhesive tape.

7. The tape holder of claim 1, further comprising a flattened handle.

* * * * *